US009755370B2

(12) United States Patent
Little et al.

(10) Patent No.: US 9,755,370 B2
(45) Date of Patent: Sep. 5, 2017

(54) FLIPPABLE ELECTRICAL PLUG CONNECTOR MOUNTED UPON PRINTED CIRCUIT BOARD

(71) Applicant: FOXCONN INTERCONNECT TECHNOLOGY LIMITED, Grand Cayman (KY)

(72) Inventors: Terrance F. Little, Fullerton, CA (US); Kuo-Chun Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/396,804

(22) Filed: Jan. 2, 2017

(65) Prior Publication Data

US 2017/0194749 A1 Jul. 6, 2017

Related U.S. Application Data

(60) Provisional application No. 62/273,456, filed on Dec. 31, 2015.

(51) Int. Cl.

| | |
|---|---|
| ***H01R 13/648*** | (2006.01) |
| ***H01R 13/6581*** | (2011.01) |
| ***H01R 13/652*** | (2006.01) |
| ***H01R 24/60*** | (2011.01) |
| *H01R 13/6585* | (2011.01) |
| *H01R 12/71* | (2011.01) |
| *H01R 13/6594* | (2011.01) |

(52) U.S. Cl.
CPC ..... *H01R 13/6581* (2013.01); *H01R 13/652* (2013.01); *H01R 24/60* (2013.01); *H01R 12/712* (2013.01); *H01R 13/6585* (2013.01); *H01R 13/6594* (2013.01)

(58) Field of Classification Search
USPC ..... 439/607.35, 607.37
See application file for complete search history.

(56) References Cited

U.S. PATENT DOCUMENTS 5,603,639 A * 2/1997 Lai ..... H01R 23/6873 439/353
9,281,626 B2 * 3/2016 Lin ..... H01R 13/6581
(Continued)

*Primary Examiner* — Tho D Ta
(74) *Attorney, Agent, or Firm* — Wei Te Chung; Ming Chieh Chang

(57) ABSTRACT

A plug connector mateable with the receptacle connector, includes an insulative housing enclosed in a metallic shell, defining a receiving cavity to receive the mating tongue, and equipped with a plurality of contacts on opposite sides. A pair of mounting ears are located on two opposite lateral ends of the housing in a transverse direction. A securing/shield plates forms a pair of locking heads extending into two opposite lateral sides of the receiving cavity to lock with a shielding plate embedded within a mating tongue of the complementary receptacle connector during mating. A metallic EMI shield encloses the metallic shell and includes a front wall with there in a front opening through which the metallic shell with the housing forwardly extends and a pair of side walls with therein a pair of slots through which the mounting ears laterally extend outwardly away from each other in the transverse direction.

17 Claims, 19 Drawing Sheets

(56) References Cited

U.S. PATENT DOCUMENTS

| | | | | |
|---|---|---|---|---|
| 2016/0020537 | A1* | 1/2016 | Ju | H01R 24/78<br>439/83 |
| 2016/0156114 | A1* | 6/2016 | Kao | H05K 1/111<br>439/83 |
| 2016/0261056 | A1* | 9/2016 | Jiang | H01R 13/6585 |
| 2016/0294101 | A1* | 10/2016 | Kao | H01R 13/502 |

* cited by examiner

10

FLIPPABLE ELECTRICAL PLUG CONNECTOR MOUNTED UPON PRINTED CIRCUIT BOARD

BACKGROUND OF THE INVENTION

1. Field of the Invention

The invention relates to an electrical connector, and particularly to a plug connector mounted upon a printed circuit board for use with a receptacle connector in a flappable manner.

2. Description of Related Art

Universal Serial Bus Type C cable and connector specification was issued on Aug. 11, 2011, disclosing the mated receptacle connector and plug connector in a flippable way. Anyhow, because the Type C connector is expected to replace all similar dimensioned/level I/O connectors, there are other additional applications for such an mated arrangement.

Hence, a modification to the electrical plug connector and the complementary receptacle connector of the Type C is desired for being adapted to be applied to some currently existing devices without significantly changing the contour or dimension of such device.

SUMMARY OF THE INVENTION

Accordingly, the object of the present invention is to provide a flippable plug connector and a complementary receptacle connector wherein the plug connector forms a capsular front contour and includes an insulative housing enclosed in a metallic shell and defining therein a rectangular receiving cavity forwardly communicating with an exterior in a front-to-back direction. A pair of mounting ears are formed on two opposite lateral ends of the housing. A metallic EMI shield can further enclose the assembled housing and shell while exposing the pair of mounting ears. Two upper and lower rows of contacts are disposed in the housing with corresponding contacting sections extending into two opposite upper and lower sides the receiving cavity wherein the upper and lower rows of contacts are diagonally symmetrically arranged with each other in both electrical and mechanical arrangement so as to meet the so-called flappable mating, i.e., the dual orientations. A pair of EMI (Electro-Magnetic Interference) plates are disposed within the shell and each of the EMI plates is sandwiched between the housing and the shell, and has a front region extending inwardly toward the receiving cavity and located in front of the contacting sections of the contacts, a rear region resiliently contacting the shell, and a pair of opposite side regions having a retention structure to retain to side portions of the housing. A metallic securing/shield plate is assembled to the housing with a pair of latches having corresponding locking heads extending into two opposite lateral sides of the receiving cavity. A printed circuit board is attached to a rear side of the housing and extends in a vertical plane perpendicular to the front-to-back direction. All the metallic securing/shielding plate, the metallic shell and the metallic shielding can have corresponding pins extending through the printed circuit board in the front-to-back direction. Another or an attachment connector is mounted upon the other side of the printed circuit board and forms a downward mating cavity in a vertical direction perpendicular to the front-to-back direction. Such another connector includes an outer metallic shield unitarily forming a spring tang located in a recess of the printed circuit board.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
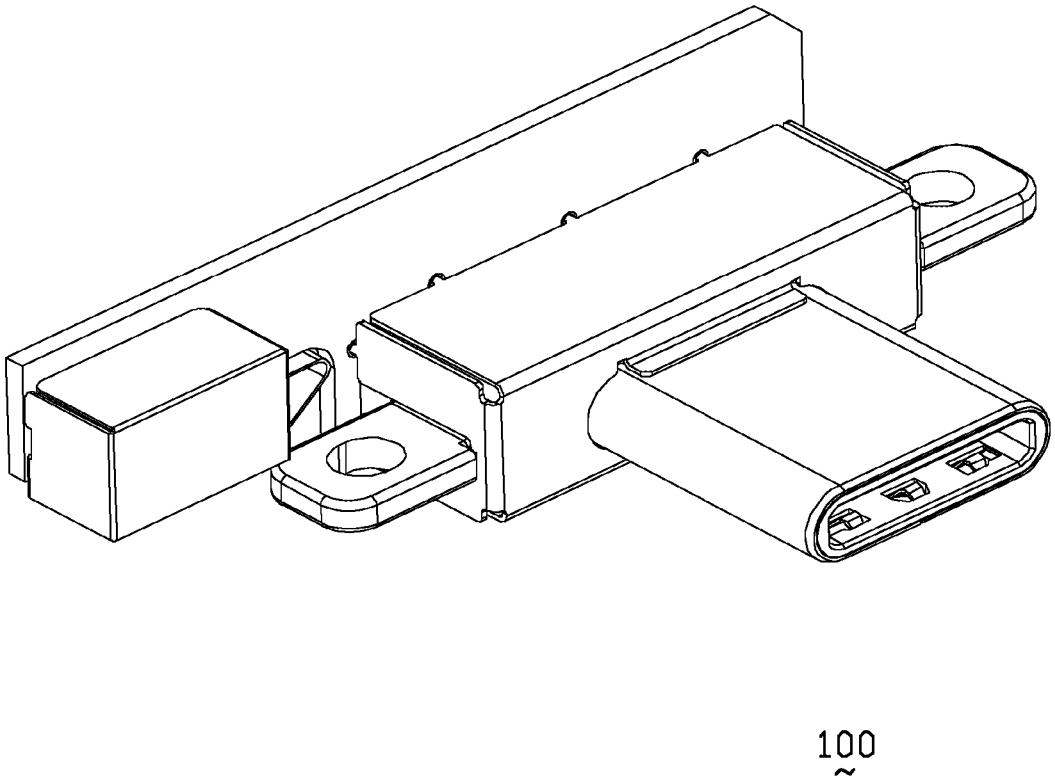
FIG. 1(A) is an assembled perspective view of an electrical connector assembly having the plug connector mounted on the printed circuit board with another connector thereon.
Figure 1B:
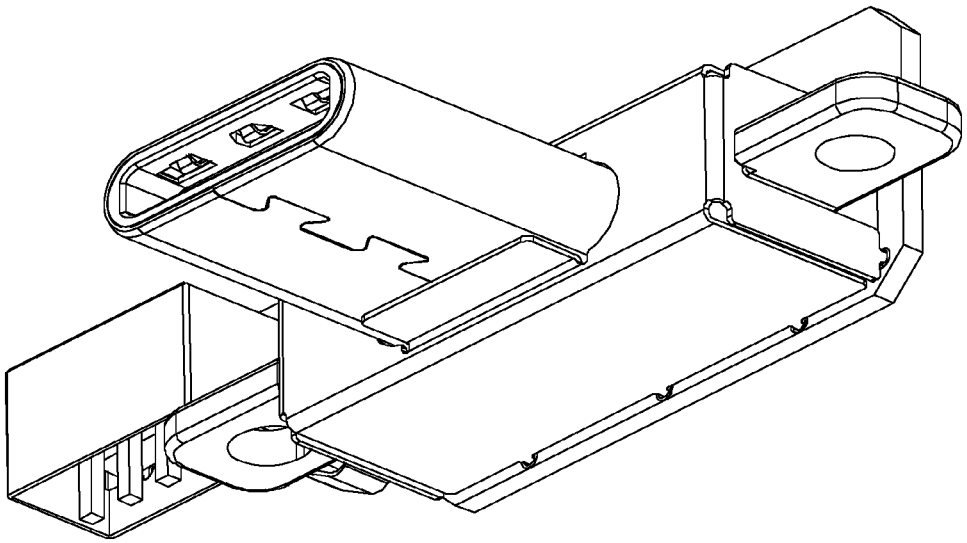
FIG. 1(B) is another assembled perspective view of the plug connector and the printed circuit board of FIG. 1(A).
Figure 2:
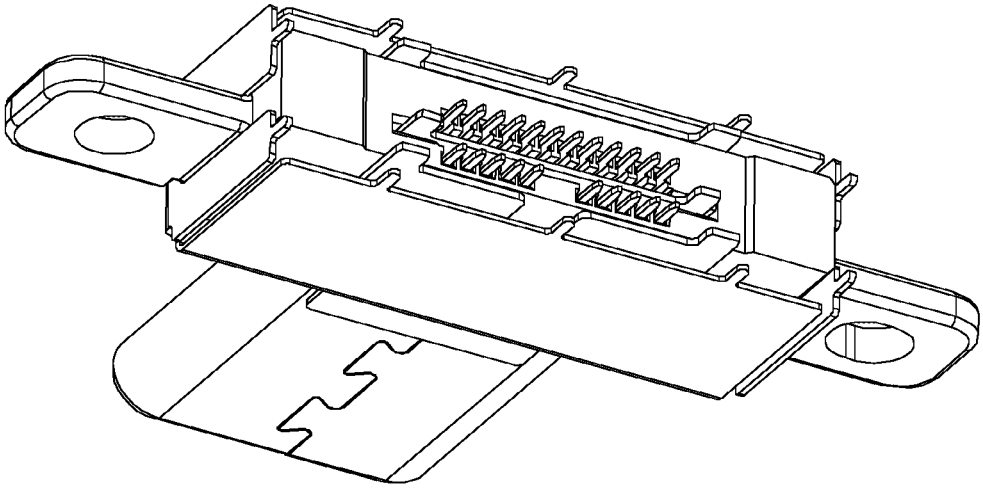
FIG. 2 is a perspective view of the plug connector of FIG. 1(A).
Figure 3:
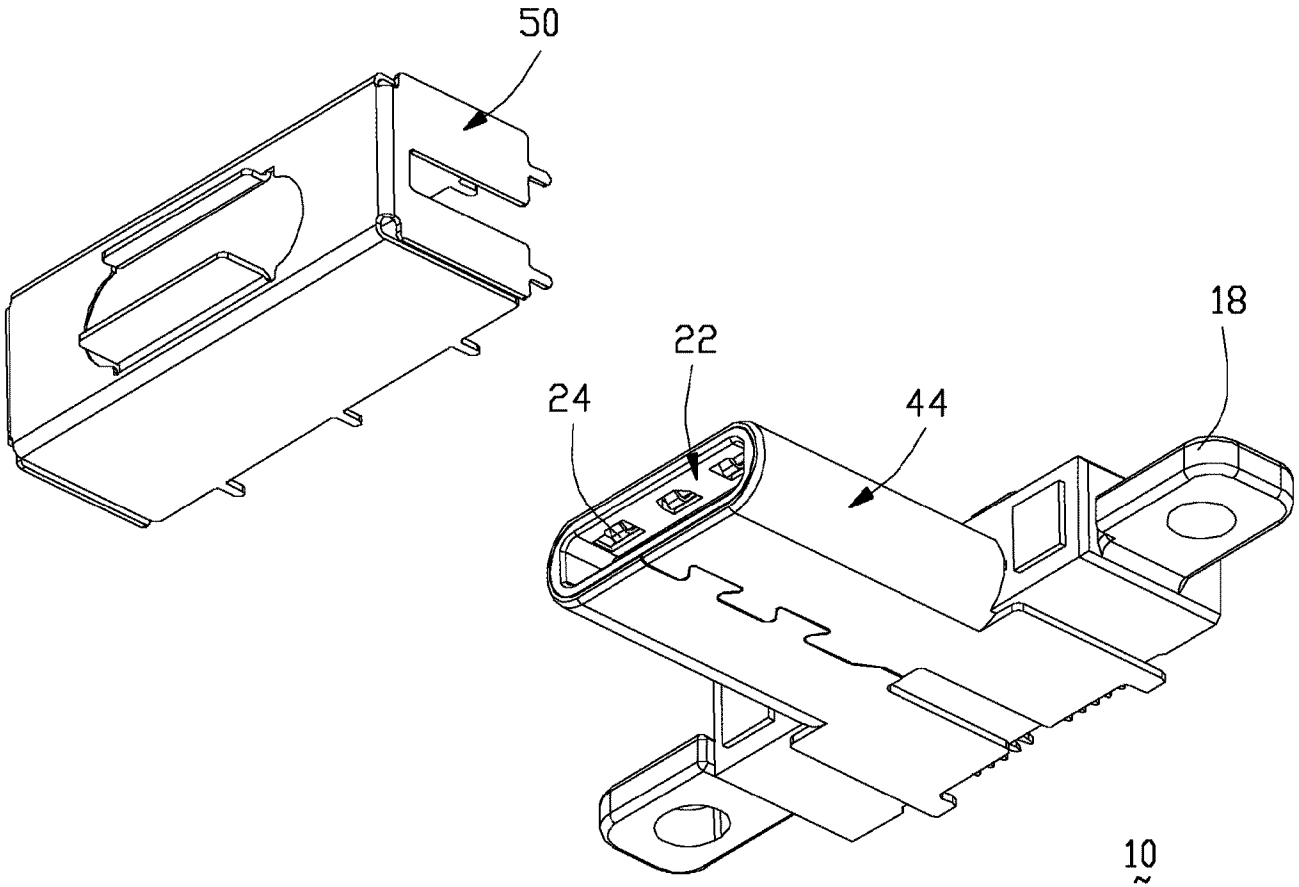
FIG. 3 is a front upward exploded perspective view of the plug connector of FIG. 2.
Figure 4A:
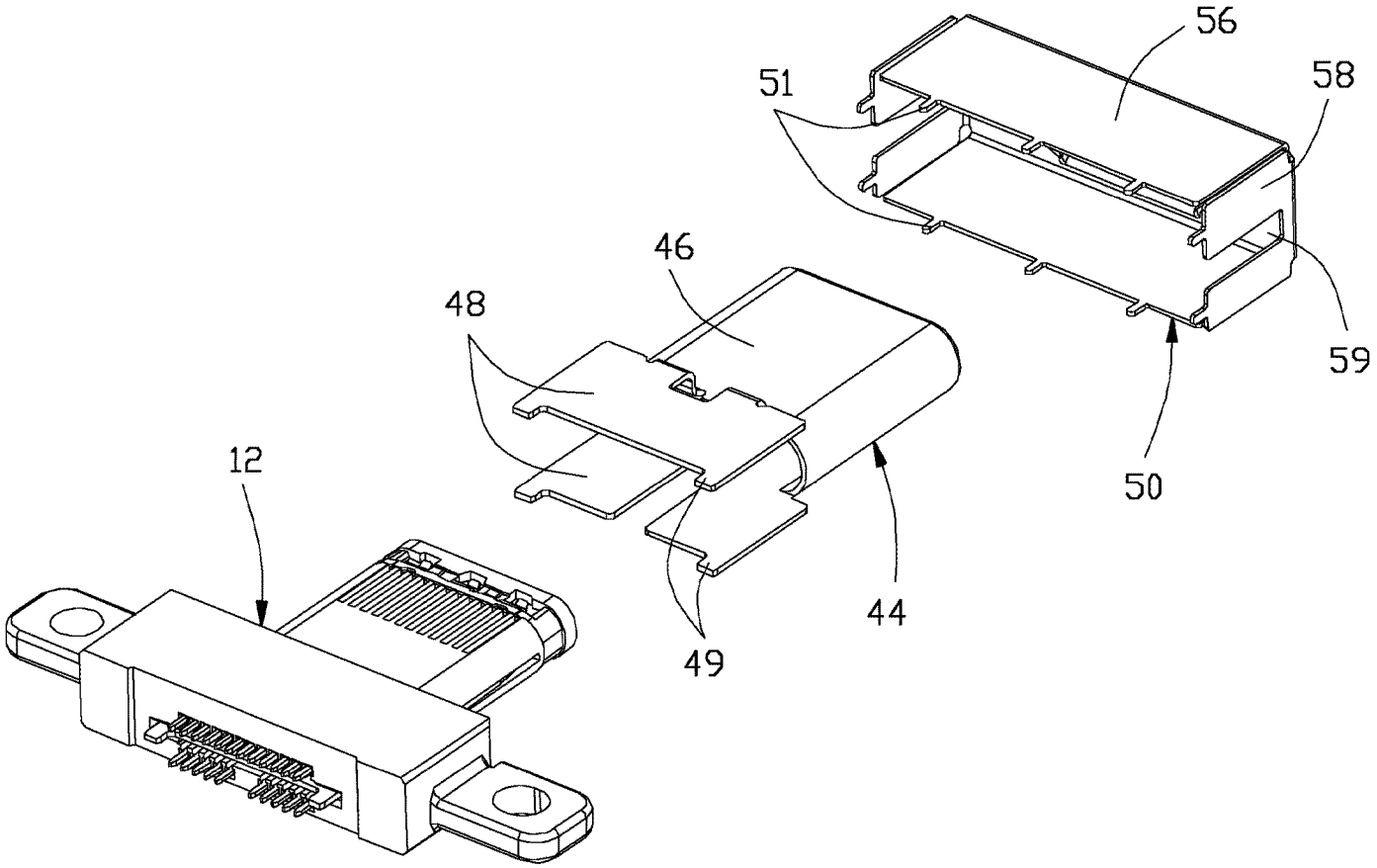
FIG. 4(A) is a rear exploded perspective view of the plug connector of FIG. 3.
Figure 4B:
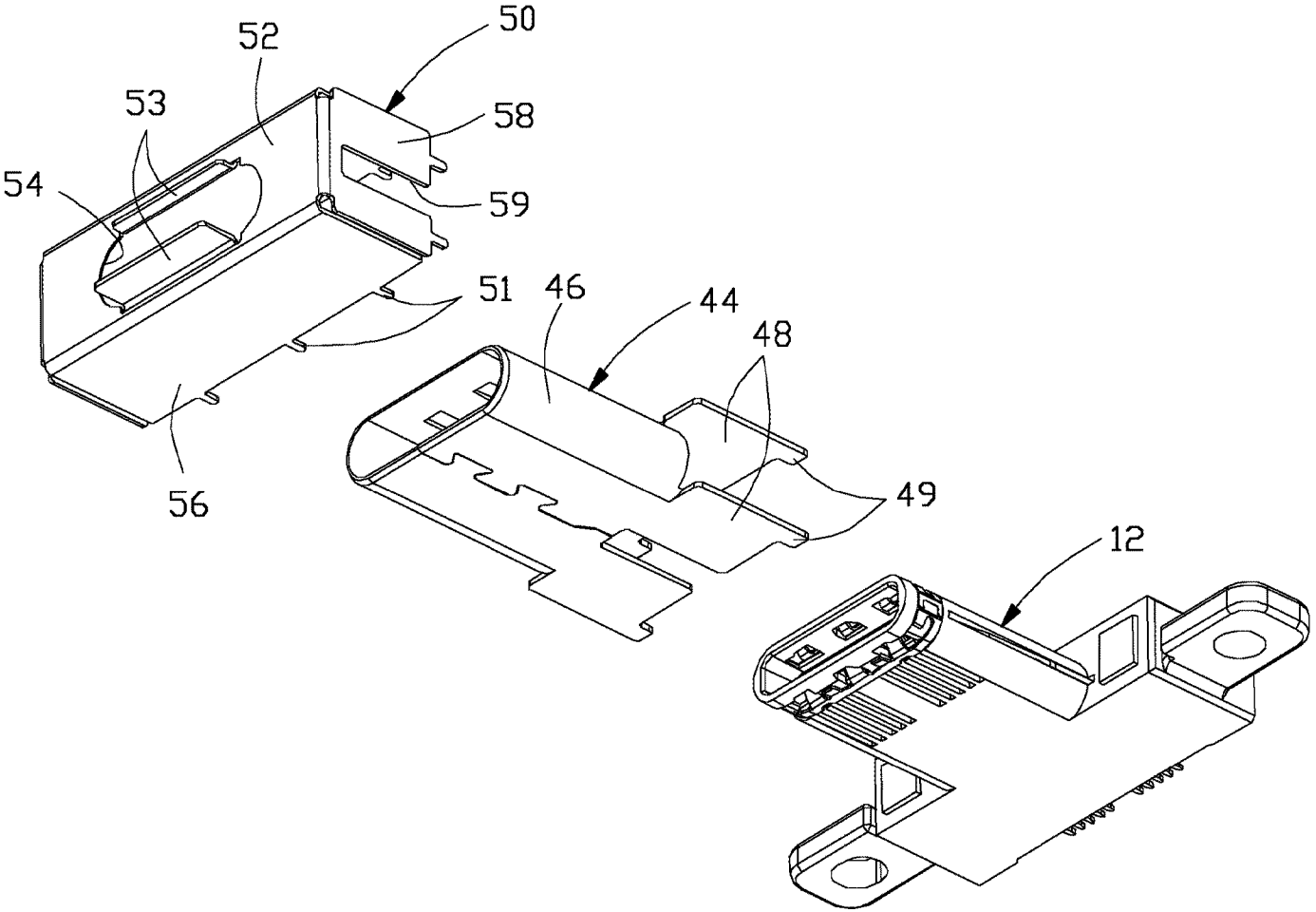
FIG. 4(B) is a front exploded perspective view of the plug connector of FIG. 3.
Figure 5A:
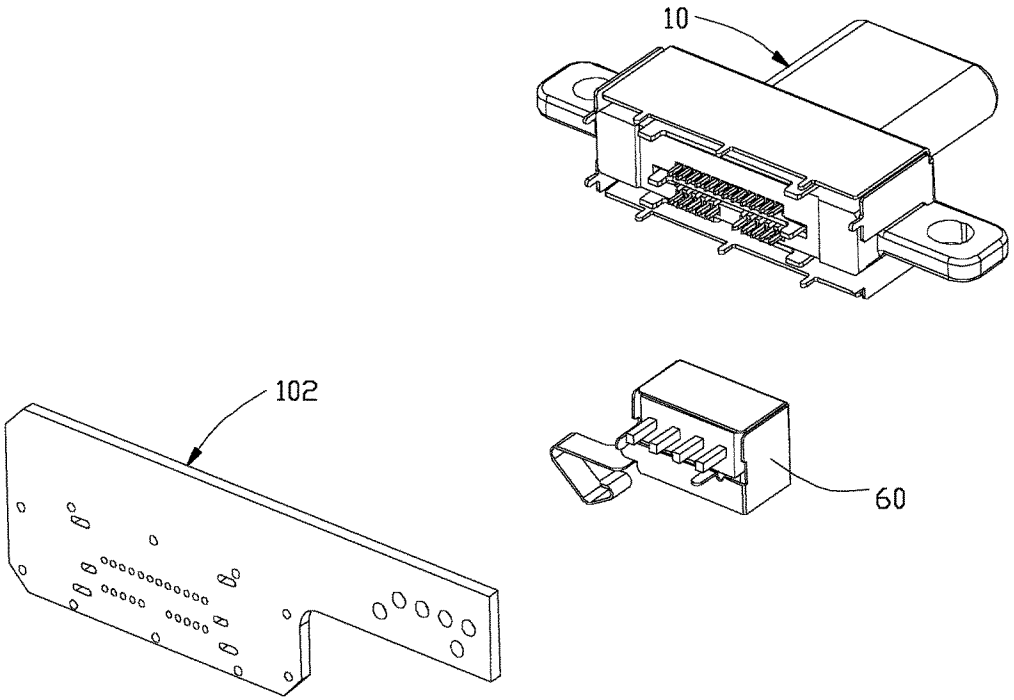
FIG. 5(A) is a rear downwardly exploded perspective view of the electrical connector assembly of FIG. 1.
Figure 5B:
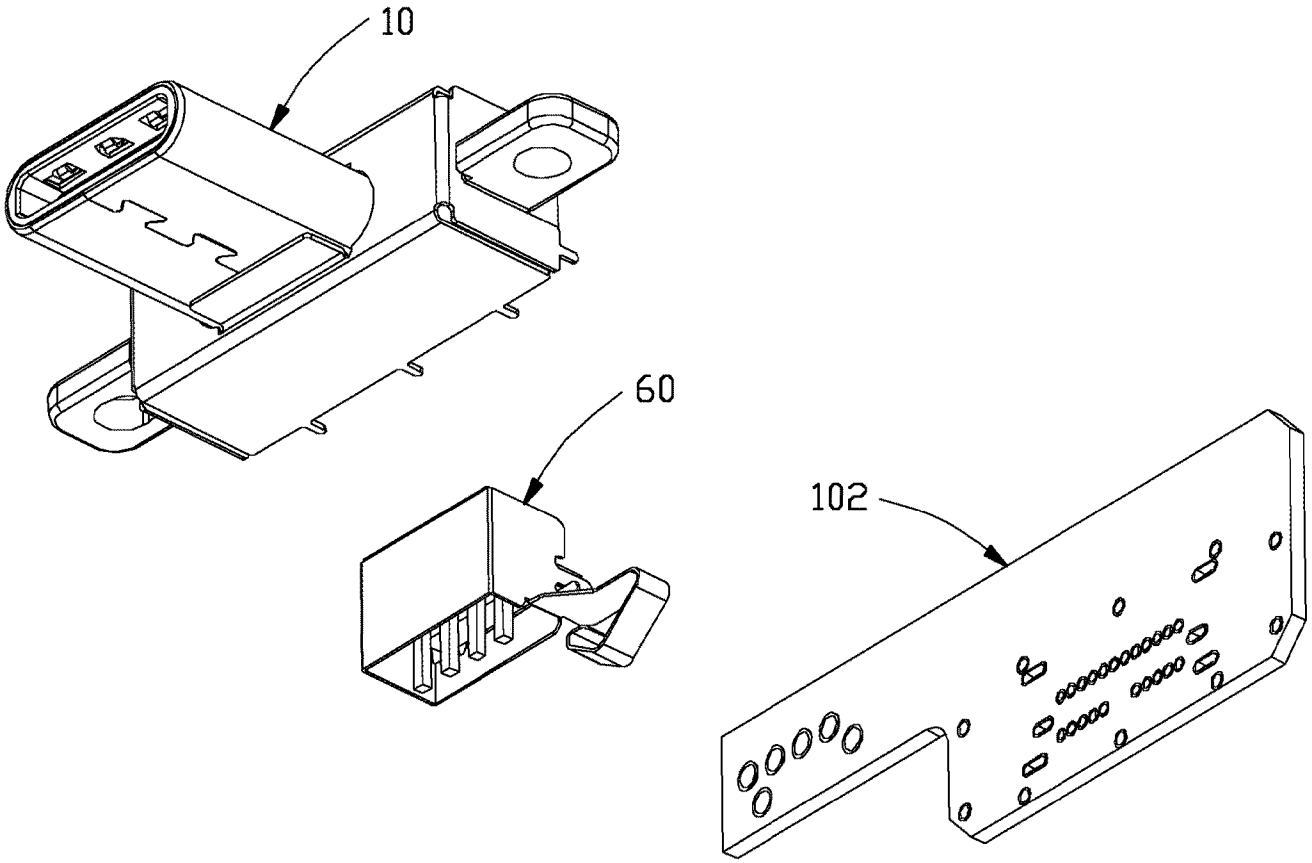
FIG. 5(B) is a front upwardly exploded perspective view of the electrical connector assembly of FIG. 1.
Figure 5C:
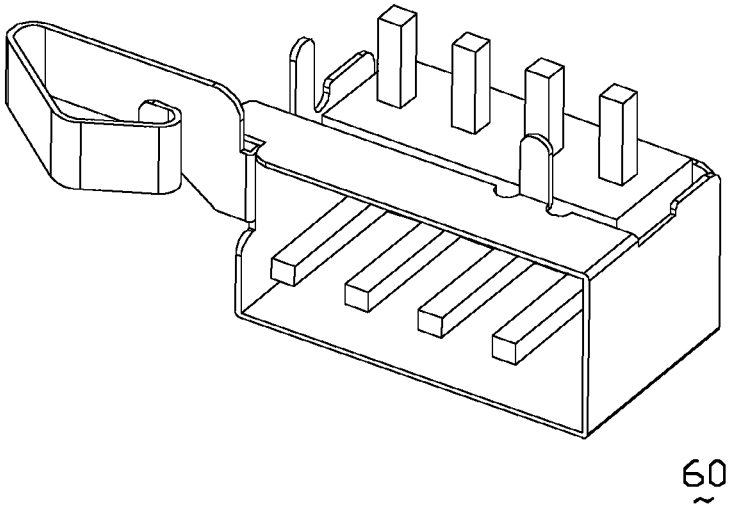
FIG. 5(C) is a perspective view of such an attachment connector for mounting on the printed circuit board of FIG. 1.
Figure 5D:
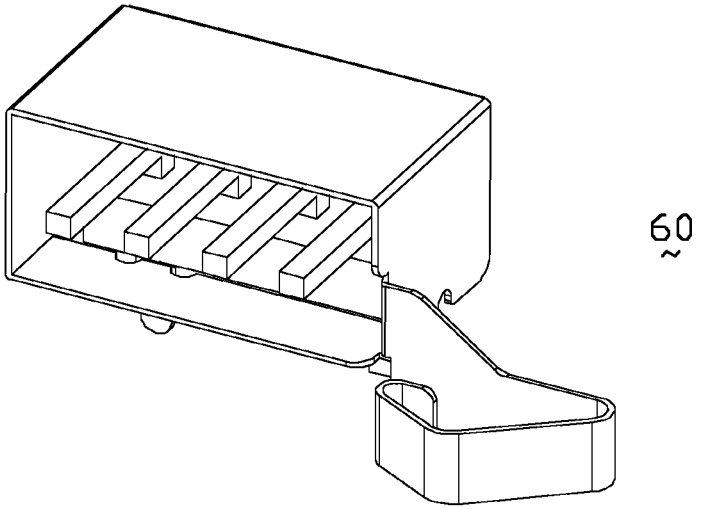
FIG. 5(D) is another perspective view of the attachment connector of FIG. 5(C).
Figure 5E:
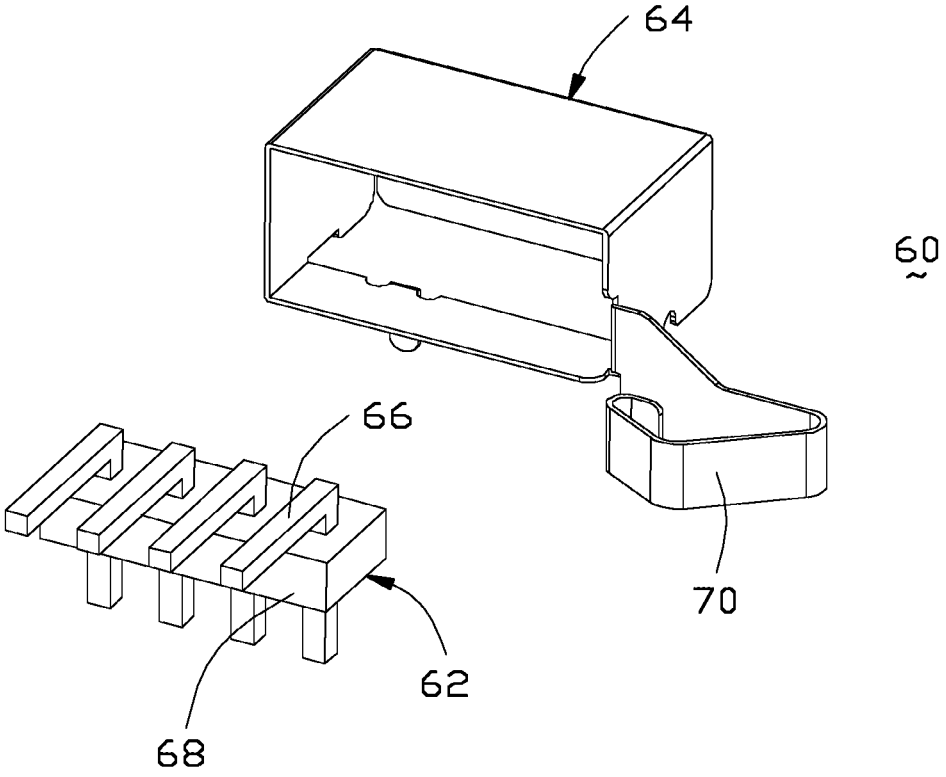
FIG. 5(E) is an exploded perspective view of the attachment connector of FIG. 5(C).
Figure 5F:
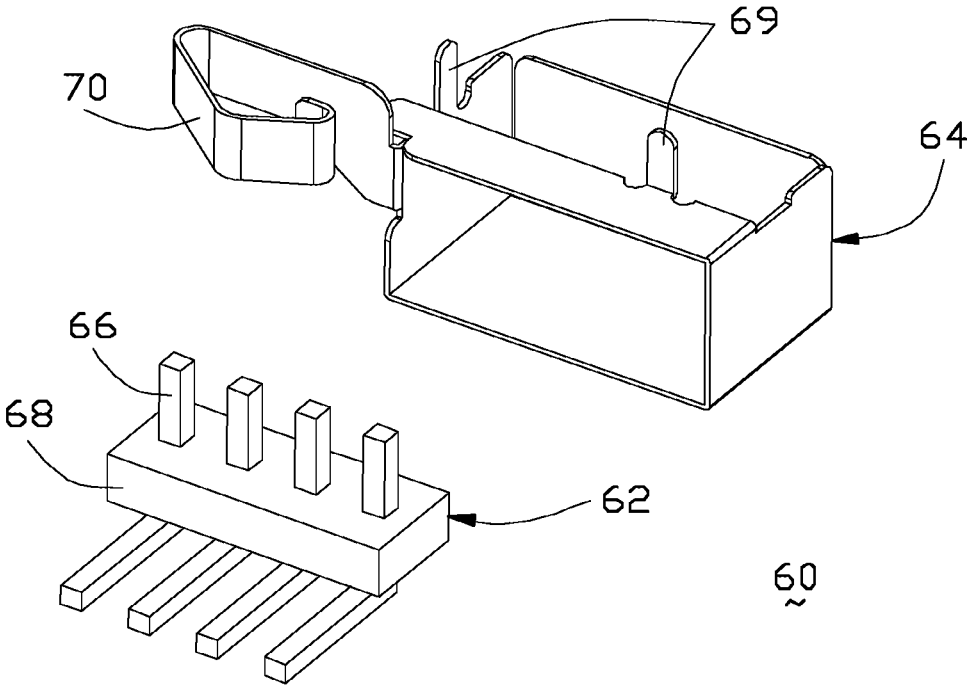
FIG. 5(F) is another exploded perspective view of the attachment connector of FIG. 5(C).
Figure 6A:
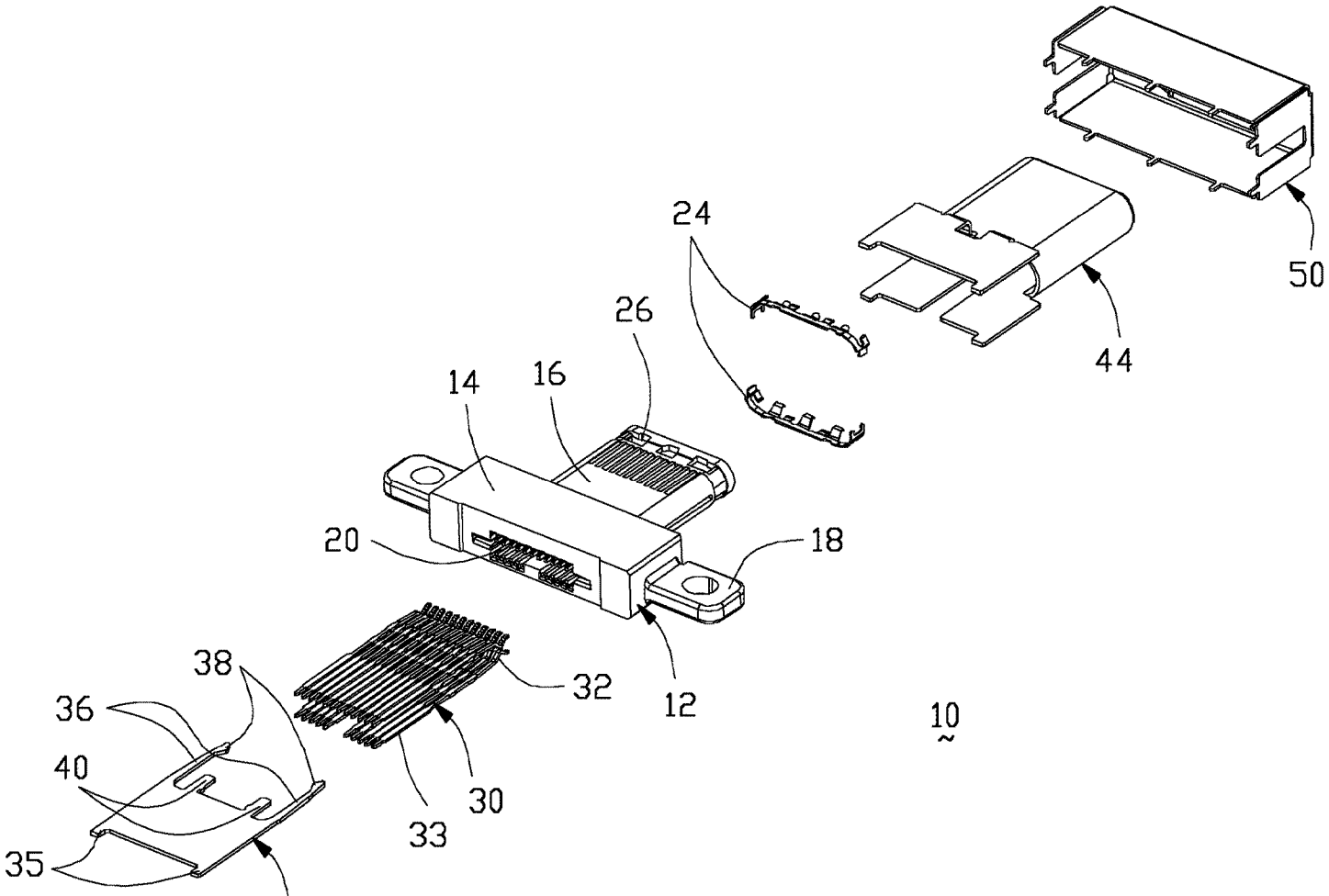
FIG. 6(A) is a further rear exploded perspective view of the plug connector of FIG. 3.
Figure 6B:
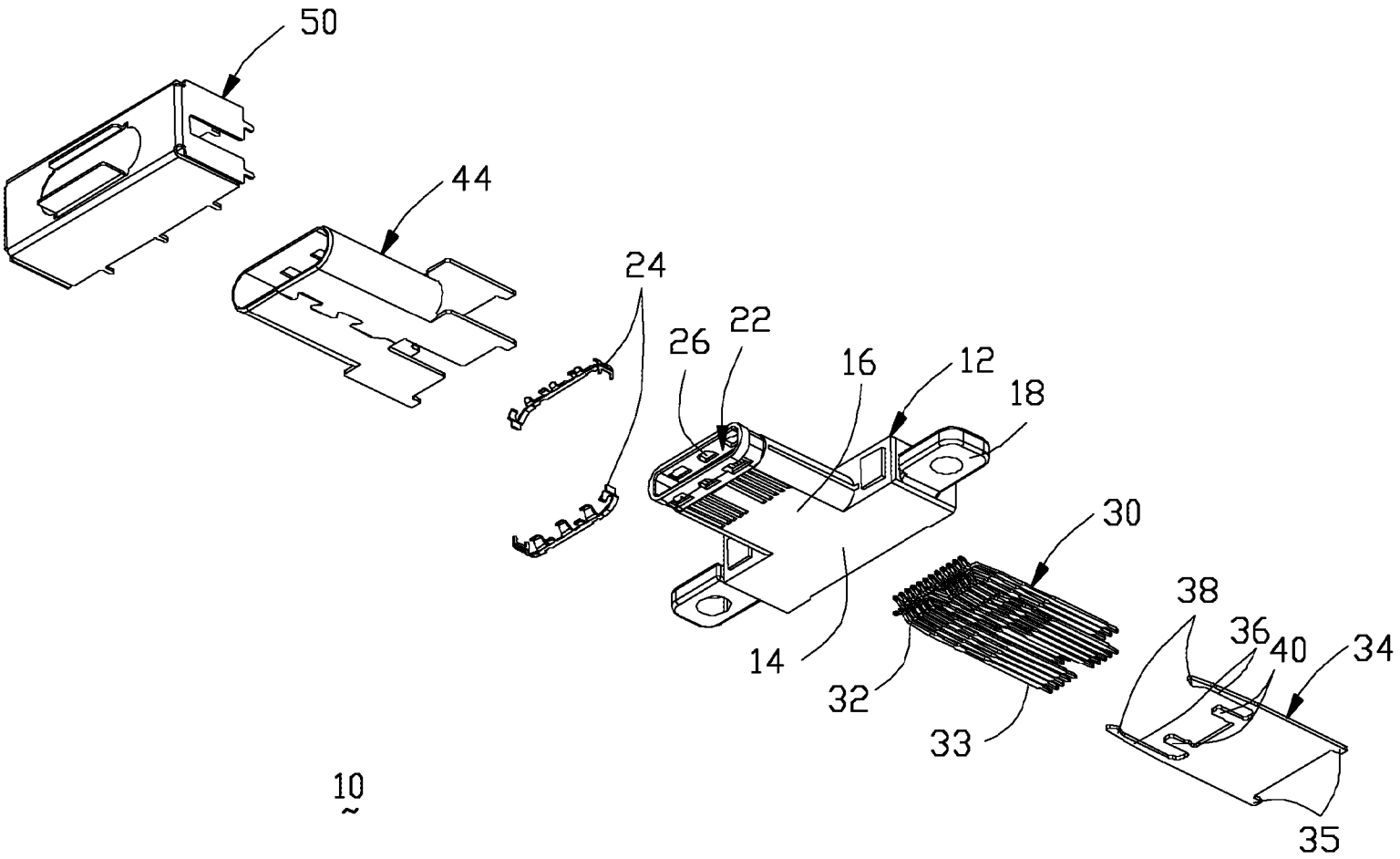
FIG. 6(B) is a further front exploded perspective view of the plug connector of FIG. 3.
Figure 7A:
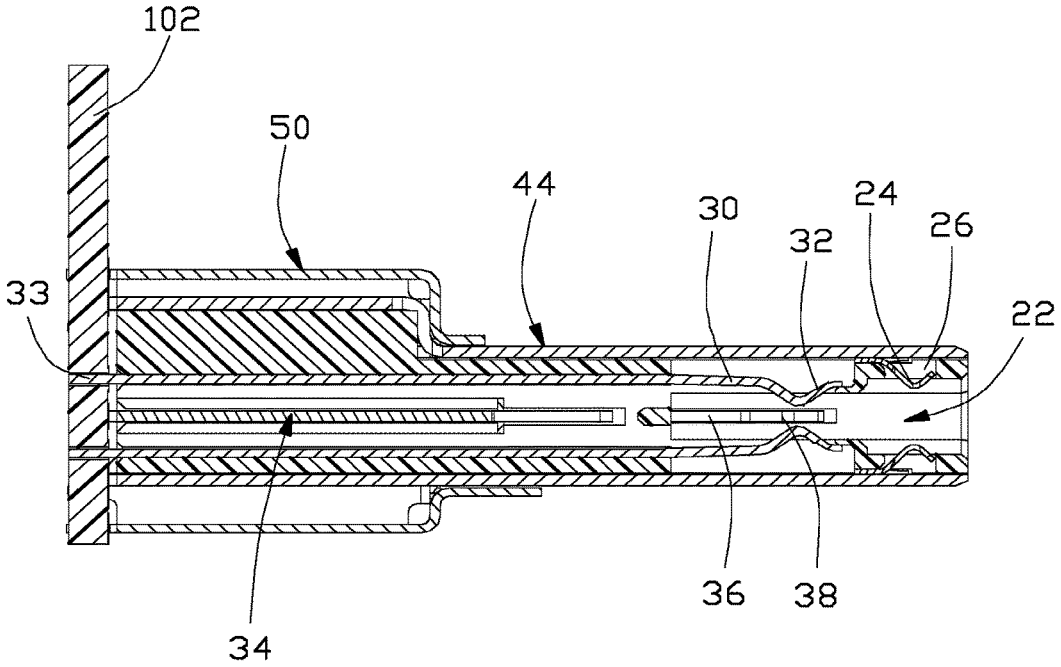
FIG. 7(A) is a cross-sectional view of the plug connector mounted upon the printed circuit board of FIG. 1.
Figure 7B:
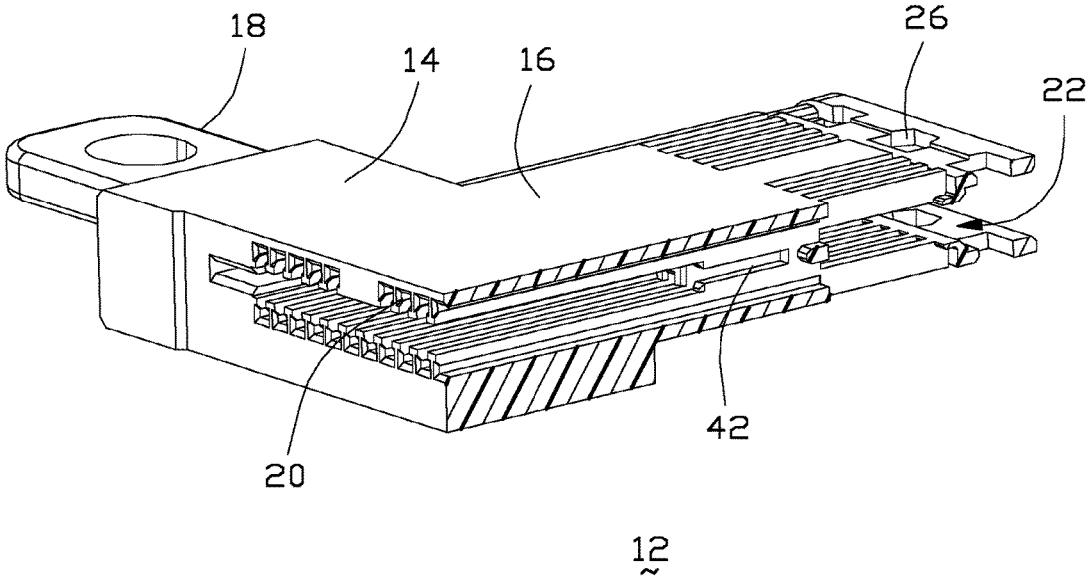
FIG. 7(B) is a cut-away partial perspective view of the plug connector of FIG. 3.
Figure 8:
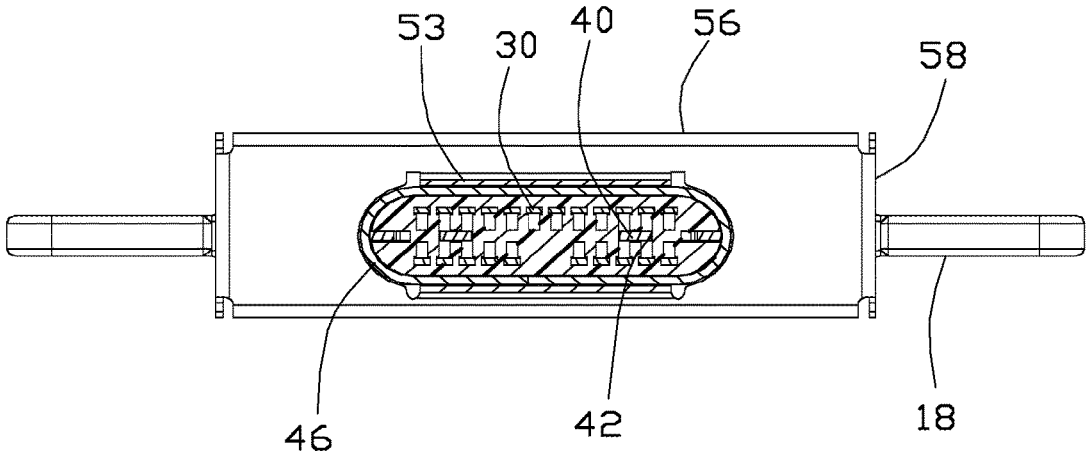
FIG. 8 is a front cross-sectional view of the plug connector of FIG. 3.

An electrical connector assembly 100 has a printed circuit board 102 with a plug connector 10 and an attachment connector 50 mounted on two different areas. The plug connector 10 includes an insulative housing 12 with a rear base portion 14 and front mating portion 16. A pair of mounting ears 18 are unitarily formed at two opposite ends of the rear base portion 14 in a transverse direction wherein each mounting ear 18 forms a mounting hole (not labeled). A plurality of passageways 20 extend through the housing 12 along a front-to-back direction. The front mating portion 16 forms a capsular contour with a rectangular receiving cavity 22 therein. A pair of spring members 24 are assembled upon the capsular contour and extend through the corresponding openings 26 and into the receiving cavity 22. A plurality of contacts 30 are inserted into the corresponding passageways 20. Each of the contacts 30 has a front mating section 32 exposed within the receiving cavity 22 and a rear mounting section 33 extending through the corresponding through holes 104 of the printed circuit board 102 in a soldering manner.

A shielding/securing plate 34 is inserted into the housing 12 and includes a pair of latches 36 at two opposite lateral ends with locking heads 38 extending into the receiving cavity 22, and two retaining lugs 40 retained within the corresponding slots 42 of the housing 12 to retain the shielding/securing plate 34 to the housing 12. Notably, the retaining lug 40 is intentionally located between the differential pair of the contacts 30 in the upper row and that in lower row in the vertical direction so as to perform another function of enhancing shielding between those two differential pairs advantageously. The shielding/securing plate 34 further includes a pair of mounting legs 35 extend through the corresponding through holes 108 of the printed circuit board 102 in a soldering manner.

A metallic shell 44 is mounted upon the housing 12 and includes a front capsular section 46 enclosing the front mating portion 16, and a pair of rear plates 48 covering the rear base portion 14. The rear plates 48 are equipped with mounting legs 49 extending through the corresponding through holes 110 of the printed circuit board 102.

A metallic EMI shield 50 further covers the pair of rear plates 48 of the shell 44 and the rear base portion 14 of the housing 12. The EMI shield 50 includes a front wall 52 with therein an opening 54 through which the front capsular section 46 and the front mating portion 16 extend, and a pair of large main walls 56 and a pair of small side walls 58 commonly receiving the pair of rear plates 48 and the rear base portion 14 therein wherein the pair of small side walls 58 include a pair of slots 59 through which the pair of mounting ears 18 laterally extend outwardly. The EMI shield 50 further includes a pair of spring plates 53 around the front opening 54 for intimately contacting the front capsular section 46 in a welded manner for EMI prevention consideration, and a plurality of mounting legs 51 extending through the corresponding through holes 112 of the printed circuit board 102.

Figure 9:
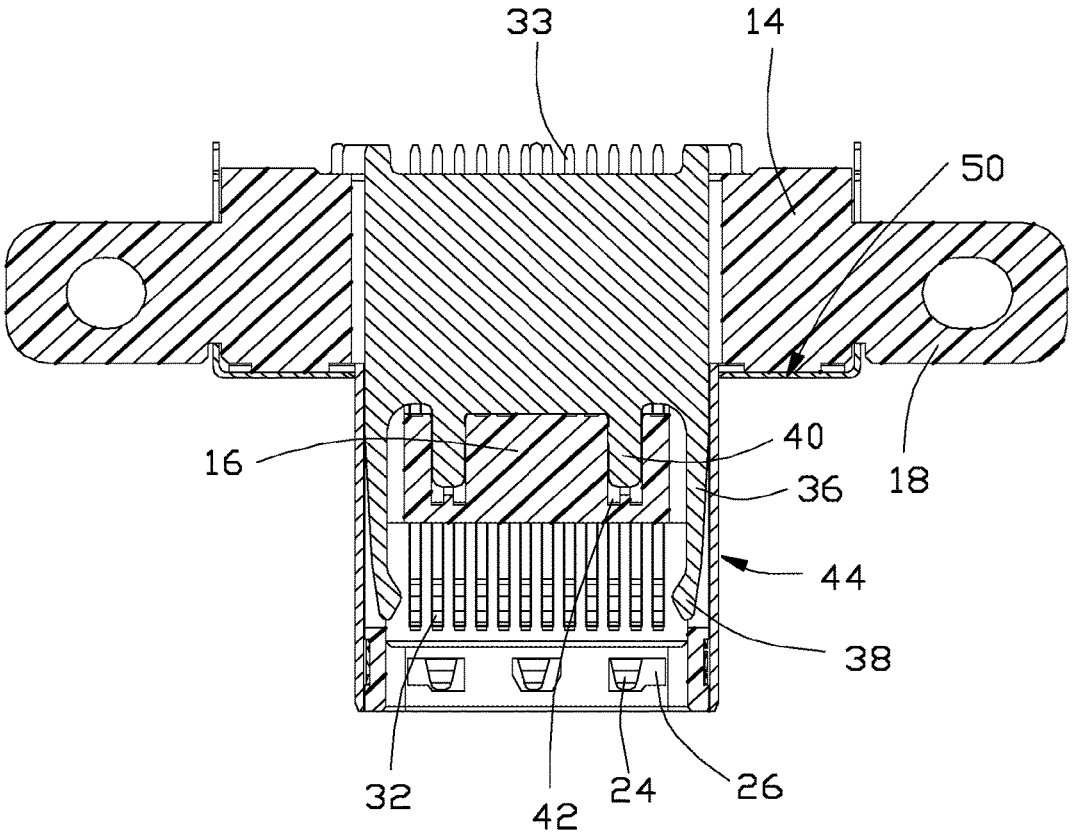
FIG. 9, is a top cross-sectional view of the plug connector of FIG. 3.
Figure 10:
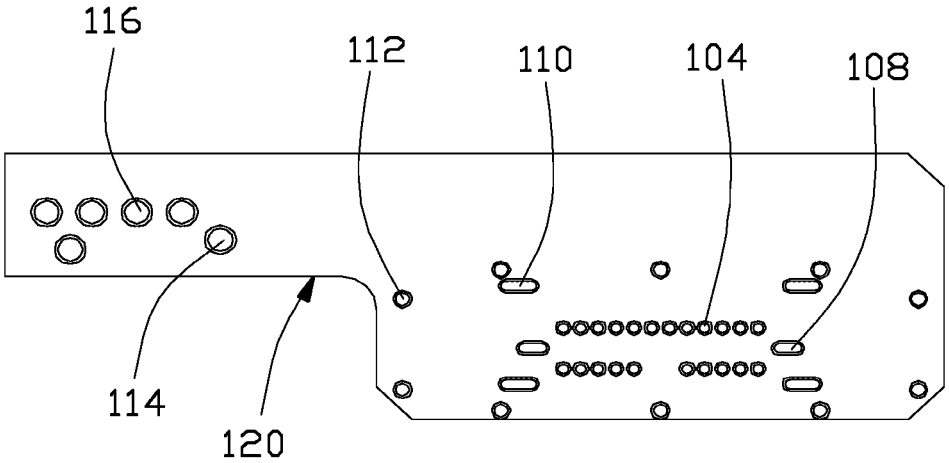
FIG. 10 is a plan view of the printed circuit board of FIG. 1.

The front face (not labeled) of the rear base portion 14 of the housing 12 forms a pair of standoffs (not labeled) against which the front wall 52 of the metallic shield 50 abut. It is also noted that easily recognized in FIG. 9, a slot (not labeled) is formed between each mounting ear 18 and the lateral end wall (not labeled) of the rear base portion 14 so as to receive a rearward edge of the corresponding side wall 58 of the metallic shield 50 for restricting/preventing the movement of the small side wall 58 with regard to the rear base portion 14 in the transverse direction.

The attachment connector 60 includes a terminal module 62 enclosed within a metallic shield 64 wherein the terminal module 62 includes a plurality of terminals 66 retained within an insulator 68. The shield 64 includes a plurality of mounting legs 69 extending through the corresponding through holes 114 of the printed circuit board 102 in a soldering manner, and the terminals includes tails extending through the corresponding through holes 116 of the printed circuit board 102 in a soldering manner. The shield 64 forms a spring arm 70 disposed within a recess 120 of the printed circuit board 102 for grounding to an external part.

What is claimed is:

1. A plug connector assembly including a plug connector for mating with a receptacle connector, said plug connector comprising: an insulative housing including a rear base portion and a front capsular mating portion defining a rectangular receiving cavity communicating with an exterior in a front-to-back direction;

two rows of contacts arranged along a transverse direction perpendicular to said front-to-back direction and disposed in the housing by opposite top and bottom sides of the receiving cavity with contacting sections exposed in said receiving cavity in a vertical direction perpendicular to both front-to-back direction and said transverse direction;

a pair of locking heads located beside the receiving cavity in the transverse direction and extending into receiving cavity;

a metallic shell enclosing said housing including a front capsular section covering the front capsular mating portion, and a rear section covering the rear base portion; and a metallic EMI shield including a front wall with therein a front opening through which said front capsular section with the front capsular mating portion extends forwardly;

wherein said contacts include tails, the metallic shell includes corresponding mounting legs and the metallic EMI shield includes corresponding mounting legs all extending along the front-to-back direction into corresponding through holes in a printed circuit board;

wherein an attachment connector is further mounted to the printed circuit board, and said attachment connector includes another metallic shell with a spring tang located within a recess of said printed circuit board.

2. The plug connector assembly as claimed in claim 1, wherein the front wall includes a pair of spring plates around the front opening, said pair of spring plates welded to the front capsular section.

3. The plug connector as claimed in claim 1, wherein the metallic shell of said attachment connector forms a mating cavity communicating with an exterior in the vertical direction, and said spring tang is deflectable in the same vertical direction.

4. The plug connector assembly as claimed in claim 1, wherein the housing further includes a pair of mounting ears located on two opposite lateral ends of the rear base portion, and the metallic EMI shield has a pair of side walls with corresponding slots through which said pair of mounting ears extend outwardly opposite to each other in said transverse direction.

5. The plug connector assembly as claimed in claim 4, wherein each of said mounting ears defines therein a through hole with an axis extending along the vertical direction while the contacts are mounted to said printed circuit board behind the housing in the front-to-back direction.

6. The plug connector assembly as claimed in claim 4, wherein a slot is formed between each mounting ear and the rear base portion to receive a rearward edge of the metallic EMI shield for restricting movement of the metallic EMI shield relative to the housing in the transverse direction.

7. The plug connector assembly as claimed in claim 1, further including a metallic securing/shielding plate includes a pair of forwardly extending lugs each aligned with corresponding differential pairs of the contacts in the vertical direction.

8. The plug connector assembly as claimed in claim 7, wherein said pair of locking heads are unitarily formed with said metallic securing/shielding plate located between said two rows of contacts in the vertical direction.

9. A plug connector assembly including a plug connector for mating with a receptacle connector, said plug connector comprising:

an insulative housing including a rear base portion and a front capsular mating portion defining a rectangular receiving cavity communicating with an exterior in a front-to-back direction;

two rows of contacts arranged along a transverse direction perpendicular to said front-to-back direction and disposed in the housing with contacting sections exposed in said receiving cavity in a vertical direction perpendicular to both front-to-back direction and said transverse direction;

a pair of locking heads located beside the receiving cavity in the transverse direction and extending into receiving cavity;

a metallic shell enclosing said housing including a front capsular section covering the front capsular mating portion, and a rear section covering the rear base portion; and a pair of mounting ears located on two opposite lateral ends of the rear base portion; wherein each of said mounting ears defines a through hole with an axis extending along the vertical direction while said contacts are mounted, along said front-to-back direction, to a printed circuit board which is located behind the housing in said front-to-back direction;

wherein an attachment connector is further mounted to the printed circuit board, and said attachment connector includes another metallic shell with a spring tang located within a recess of said printed circuit board.

10. The plug connector assembly as claimed in claim 9, wherein the metallic shell includes mounting legs mounted to the printed circuit board in said front-to-back direction.

11. The plug connector assembly as claimed in claim 9, wherein the metallic shell of said attachment connector forms a mating cavity communicating with an exterior in the vertical direction, and said spring tang is deflectable in the same vertical direction.

12. The plug connector assembly as claimed in claim 9, further including a metallic EMI shield including a front wall with therein a front opening through which said front capsular section with the front capsular mating portion extends forwardly.

13. The plug connector assembly as claimed in claim 12, wherein the front wall includes a pair of spring plates around the front opening, said pair of spring plates welded to the front capsular section.

14. The plug connector assembly as claimed in claim 12, wherein the metallic EMI shield has a pair of side walls with corresponding slots through which said pair of mounting ears extend outwardly opposite to each other in said transverse direction.

15. A plug connector assembly comprising:

a plug connector for mating with a receptacle connector, said plug connector comprising:

an insulative housing including a rear base portion and a front capsular mating portion defining a rectangular receiving cavity communicating with an exterior in a front-to-back direction;

two rows of contacts arranged along a transverse direction perpendicular to said front-to-back direction and disposed in the housing by opposite top and bottom sides of the receiving cavity with contacting sections exposed in said receiving cavity in a vertical direction perpendicular to both front-to-back direction and said transverse direction;

a pair of locking heads located beside the receiving cavity in the transverse direction and extending into receiving cavity;

a metallic shell enclosing said housing including a front capsular section covering the front capsular mating portion, and a rear section covering the rear base portion;

a printed circuit board on which the plug connector is mounted in the front-to-back direction, said printed circuit board defining a recess beside said plug connector; and an attachment connector further mounted to the printed circuit board, wherein said attachment connector includes another metallic shell with a spring tang located within said recess of said printed circuit board.

16. The plug connector as claimed in claim 15, wherein the metallic shell of said attachment connector forms a mating cavity communicating with an exterior in the vertical direction, and said spring tang is deflectable in the same vertical direction.

17. The plug connector as claimed in claim 15, wherein said pair of locking heads are unitarily formed with a metallic securing/shielding plate located between said two rows of contacts in the vertical direction, and said metallic securing/shielding plate has mounting legs mounted to the printed circuit board in said front-to-back direction.

* * * * *